US010597210B2

(12) United States Patent
Franca et al.

(10) Patent No.: US 10,597,210 B2
(45) Date of Patent: Mar. 24, 2020

(54) FLEXIBLE POUCH WITH MICROCAPILLARY DISPENSING SYSTEM

(71) Applicant: Dow Global Technologies LLC, Midland, MI (US)

(72) Inventors: Marcos P. Franca, Sao Paulo (BR); Bruno Rufato Pereira, Sao Paulo (BR); Wenyi Huang, Midland, MI (US); Laura J. Dietsche, Midland, MI (US)

(73) Assignee: Dow Global Technologies LLC, Midland, MI (US)

( * ) Notice: Subject to any disclaimer, the term of this patent is extended or adjusted under 35 U.S.C. 154(b) by 0 days.

(21) Appl. No.: 15/740,140

(22) PCT Filed: Jun. 24, 2016

(86) PCT No.: PCT/US2016/039216

§ 371 (c)(1),
(2) Date: Dec. 27, 2017

(87) PCT Pub. No.: WO2017/003851

PCT Pub. Date: Jan. 5, 2017

(65) Prior Publication Data

US 2018/0194528 A1 Jul. 12, 2018

Related U.S. Application Data

(60) Provisional application No. 62/185,962, filed on Jun. 29, 2015.

(51) Int. Cl.
*B65D 75/58* (2006.01)
*B05B 1/14* (2006.01)
(Continued)

(52) U.S. Cl.
CPC ..... *B65D 75/5811* (2013.01); *B05B 1/14* (2013.01); *B05B 11/047* (2013.01); *B65D 75/5822* (2013.01); *B65D 37/00* (2013.01)

(58) Field of Classification Search
CPC .. B65D 75/30; B65D 75/5883; B65D 75/008; B65D 75/20; B65D 75/5861;
(Continued)

(56) References Cited

U.S. PATENT DOCUMENTS 2,517,027 A * 8/1950 Rado ..... B65D 47/2031 222/107
3,072,248 A * 1/1963 Bishop ..... B65D 75/52 383/209
(Continued)

FOREIGN PATENT DOCUMENTS

| | | |
|---|---|---|
| CH | 496586 A | 9/1970 |
| EP | 1598281 A1 | 11/2005 |
| EP | 2186742 A1 | 5/2010 |

*Primary Examiner* — Charles Cheyney
(74) *Attorney, Agent, or Firm* — Quarles & Brady LLP

(57) ABSTRACT

The present disclosure provides a flexible pouch. In an embodiment, the flexible pouch includes opposing flexible films. The opposing flexible films define a common peripheral edge. The flexible pouch includes a microcapillary strip sealed between the opposing flexible films. A first side of the microcapillary strip is located at a first side of the common peripheral edge. A second side of the microcapillary strip is located at a second side of the common peripheral edge. A peripheral seal extends along at least a portion of the common peripheral edge. The peripheral seal includes a sealed microcapillary segment.

20 Claims, 10 Drawing Sheets

(51) Int. Cl.
*B05B 11/04* (2006.01)
*B65D 37/00* (2006.01)

(58) Field of Classification Search
CPC ..... B65D 75/5855; B65D 75/5888; B65D 75/585; B65D 75/5822; B65D 75/5811; B65D 83/0055
USPC ..... 222/92–107
See application file for complete search history.

(56) References Cited

U.S. PATENT DOCUMENTS 3,155,282 A * 11/1964 Leblanc ..... B65D 75/5811 206/484
3,418,059 A * 12/1968 Robe ..... B29C 57/00 222/103
3,510,054 A * 5/1970 Di Carlo ..... B65D 75/5811 206/484.2
3,589,823 A * 6/1971 Hendrickson ..... A46B 11/0003 15/104.94
4,576,316 A * 3/1986 Foster ..... B65D 75/5894 206/484
4,872,556 A * 10/1989 Farmer ..... B65D 75/5822 222/107
5,617,974 A * 4/1997 Sawyer, Jr. ..... A01C 15/02 222/107
5,709,479 A * 1/1998 Bell ..... B65D 75/008 383/10
5,785,428 A * 7/1998 Mazzocchi ..... B65D 33/01 383/103
5,931,596 A * 8/1999 Javier ..... A46B 11/06 401/268
6,439,792 B1 * 8/2002 Beguin ..... B65D 75/5811 206/484
7,461,992 B2 * 12/2008 Griffon ..... A45D 37/00 132/307
7,517,484 B2 4/2009 Wu
9,061,819 B2 * 6/2015 Kane, Jr. ..... B65D 25/08
9,198,833 B2 * 12/2015 Schwarz ..... A61J 7/00
2003/0123919 A1 * 7/2003 Gueret ..... A45D 34/00 401/130
2004/0144811 A1 7/2004 Pennaneac
2008/0164288 A1 * 7/2008 Singleton ..... A01C 7/02 222/465.1
2008/0193198 A1 8/2008 LaFlamme et al.
2009/0011182 A1 1/2009 Mackley et al.
2009/0139993 A1 6/2009 Last
2009/0206108 A1 8/2009 Lee
2011/0020574 A1 1/2011 Mackley et al.
2013/0319575 A1 12/2013 Mendyk
2014/0061235 A1 * 3/2014 Ankudinov ..... B65D 75/5805 222/107
2015/0014364 A1 1/2015 Greenfield et al.
2015/0315345 A1 11/2015 Zalamea et al.
2016/0016695 A1 1/2016 Pereira et al.

* cited by examiner

FLEXIBLE POUCH WITH MICROCAPILLARY DISPENSING SYSTEM

BACKGROUND

The present disclosure is directed to a flexible pouch with a microcapillary dispensing system.

Flexible pouches are gaining market acceptance versus rigid packaging in many applications. In the food, home care, and personal care segments, flexible pouches offer the advantages of lower weight, efficient use and access to contents, good visual appeal, and better overall sustainability compared to rigid packaging.

Utilization of flexible pouches is still limited due to lack of specific functionalities, such as flow control, for example. Thus, flexible pouches are typically used as refill packages where the flexible pouch is opened and its contents poured into a previously used rigid container having a removable nozzle or spout. The nozzle or spout provides the rigid container with precision flow control.

Attempts for flow control in flexible pouches is achieved in stand-up pouches (SUPS) with the addition of a rigid fitment that is assembled to the SUP flexible structure by a heat-sealing process. These rigid fitments typically have a canoe shaped base that is placed between the films that form the SUP, the films are heat-sealed using a specialized heat seal bar that has the unique shape to accommodate the spout base. The heat sealing process is inefficient as it is slow, requiring specialized tooling. The heat sealing process is prone to significant amount of failures (leaks) due to frequent misalignment of the spout to shaped heat bars resulting in poor contact and sealing between spout and films. The heat sealing process requires careful quality control, thus the high final cost of the fitment in a SUP makes it prohibitive for some low cost applications.

Rigid containers currently dominate the spray segment. Commonplace are rigid containers with specialized spray nozzles or trigger pump sprays for the application of familiar household products such as disinfectants, glass cleansers, and liquid waxes; personal care items such as creams, lotions, and sunscreen; and even food products such as salad dressings and sauces.

Despite the spray control afforded by such packaging systems, rigid containers are disadvantageous because they are heavy, expensive to produce, and the spray component is typically not recyclable.

The art recognizes the need for a flexible pouch that is capable of delivering its content by way of a spray application and without the need for a rigid spray component. A need further exists for a flexible container that is lightweight, recyclable and requires no rigid components.

SUMMARY

The present disclosure provides a process for producing a flexible pouch capable of delivering a spray—and without any rigid components.

The present disclosure provides a flexible pouch. In an embodiment, the flexible pouch includes opposing flexible films. The opposing flexible films define a common peripheral edge. The flexible pouch includes a microcapillary strip sealed between the opposing flexible films. A first side of the microcapillary strip is located at a first side of the common peripheral edge. A second side of the microcapillary strip is located at a second side of the common peripheral edge. A peripheral seal extends along at least a portion of the common peripheral edge. The peripheral seal includes a sealed microcapillary segment.

The present disclosure provides another flexible pouch. In an embodiment, the flexible pouch includes opposing flexible films. The opposing flexible films define a common peripheral edge. The flexible pouch includes a microcapillary strip located at an edge offset distance between the opposing flexible films. The microcapillary strip is sealed between the opposing flexible films. A first side of the microcapillary strip is located at a first side of the common peripheral edge and a second side of the microcapillary strip is located at a second side of the common peripheral edge. A peripheral seal extends along at least a portion of the common peripheral edge.

An advantage of the present disclosure is a pillow pouch, a sachet, or a flexible SUP that is capable of delivering a controlled spray of a liquid, without the need for a rigid spray component.

DEFINITIONS

Figure 1:
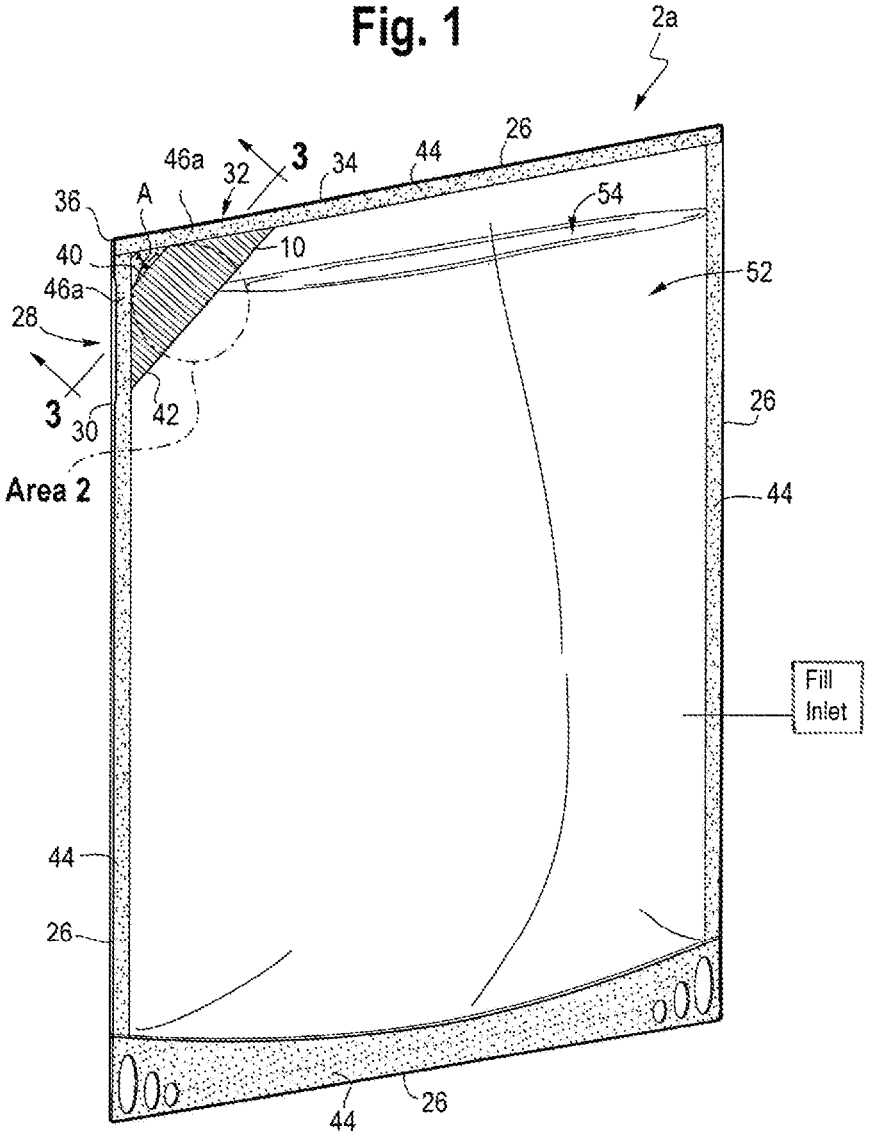
FIG. 1 is perspective view of a flexible pouch with a microcapillary dispensing system in accordance with an embodiment of the present disclosure.

All references to the Periodic Table of the Elements herein shall refer to the Periodic Table of the Elements, published and copyrighted by CRC Press, Inc., 2003. Also, any references to a Group or Groups shall be to the Groups or Groups reflected in this Periodic Table of the Elements using the IUPAC system for numbering groups. Unless stated to the contrary, implicit from the context, or customary in the art, all parts and percents are based on weight. For purposes of United States patent practice, the contents of any patent, patent application, or publication referenced herein are hereby incorporated by reference in their entirety (or the equivalent US version thereof is so incorporated by reference), especially with respect to the disclosure of synthetic techniques, definitions (to the extent not inconsistent with any definitions provided herein) and general knowledge in the art.

The numerical ranges disclosed herein include all values from, and including, the lower value and the upper value. For ranges containing explicit values (e.g., 1, or 2, or 3 to 5, or 6, or 7) any subrange between any two explicit values is included (e.g., 1 to 2; 2 to 6; 5 to 7; 3 to 7; 5 to 6; etc.).

Unless stated to the contrary, implicit from the context, or customary in the art, all parts and percents are based on weight, and all test methods are current as of the filing date of this disclosure.

The term "composition," as used herein, refers to a mixture of materials which comprise the composition, as well as reaction products and decomposition products formed from the materials of the composition.

The terms "comprising," "including," "having," and their derivatives, are not intended to exclude the presence of any additional component, step or procedure, whether or not the same is specifically disclosed. In order to avoid any doubt, all compositions claimed through use of the term "comprising" may include any additional additive, adjuvant, or compound, whether polymeric or otherwise, unless stated to the contrary. In contrast, the term, "consisting essentially of" excludes from the scope of any succeeding recitation any other component, step or procedure, excepting those that are not essential to operability. The term "consisting of" excludes any component, step or procedure not specifically delineated or listed.

Density is measured in accordance with ASTM D 792 with results reported in grams (g) per cubic centimeter (cc), or g/cc.

An "ethylene-based polymer," as used herein, is a polymer that contains more than 50 mole percent polymerized ethylene monomer (based on the total amount of polymerizable monomers) and, optionally, may contain at least one comonomer.

Melt flow rate (MFR) is measured in accordance with ASTM D 1238, Condition 280° C./2.16 kg (g/10 minutes).

Melt index (MI) is measured in accordance with ASTM D 1238, Condition 190° C./2.16 kg (g/10 minutes).

Shore A hardness is measured in accordance with ASTM D 2240.

Tm or "melting point" as used herein (also referred to as a melting peak in reference to the shape of the plotted DSC curve) is typically measured by the DSC (Differential Scanning calorimetry) technique for measuring the melting points or peaks of polyolefins as described in U.S. Pat. No. 5,783,638. It should be noted that many blends comprising two or more polyolefins will have more than one melting point or peak, many individual polyolefins will comprise only one melting point or peak.

An "olefin-based polymer," as used herein, is a polymer that contains more than 50 mole percent polymerized olefin monomer (based on total amount of polymerizable monomers), and optionally, may contain at least one comonomer. Nonlimiting examples of olefin-based polymer include ethylene-based polymer and propylene-based polymer.

A "polymer" is a compound prepared by polymerizing monomers, whether of the same or a different type, that in polymerized form provide the multiple and/or repeating "units" or "mer units" that make up a polymer. The generic term polymer thus embraces the term homopolymer, usually employed to refer to polymers prepared from only one type of monomer, and the term copolymer, usually employed to refer to polymers prepared from at least two types of monomers. It also embraces all forms of copolymer, e.g., random, block, etc. The terms "ethylene/α-olefin polymer" and "propylene/α-olefin polymer" are indicative of copolymer as described above prepared from polymerizing ethylene or propylene respectively and one or more additional, polymerizable α-olefin monomer. It is noted that although a polymer is often referred to as being "made of" one or more specified monomers, "based on" a specified monomer or monomer type, "containing" a specified monomer content, or the like, in this context the term "monomer" is understood to be referring to the polymerized remnant of the specified monomer and not to the unpolymerized species. In general, polymers herein are referred to has being based on "units" that are the polymerized form of a corresponding monomer.

A "propylene-based polymer" is a polymer that contains more than 50 mole percent polymerized propylene monomer (based on the total amount of polymerizable monomers) and, optionally, may contain at least one comonomer.

DETAILED DESCRIPTION

The present disclosure provides a flexible pouch. In an embodiment, the flexible pouch includes opposing flexible films. The opposing flexible films define a common peripheral edge. A microcapillary strip is sealed between the opposing flexible films. A first side of the microcapillary strip is located at a first side of the common peripheral edge and a second side of the microcapillary strip is located at a second side of the common peripheral edge. A peripheral seal extends along at least a portion of the common peripheral edge. The peripheral seal includes a sealed microcapillary segment.

1. Microcapillary Strip

Figure 2:
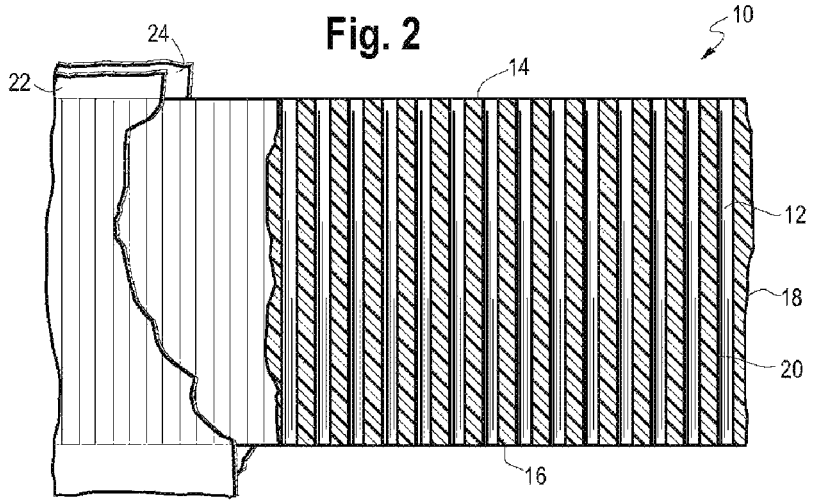
FIG. 2 is a cut-away view of Area 2 of FIG. 1.
Figure 3:
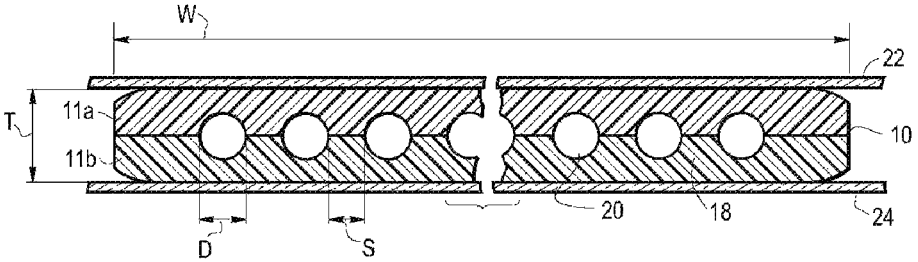
FIG. 3 is a cross sectional view of the microcapillary strip taken along line 3-3 of FIG. 1.
Figure 3A:
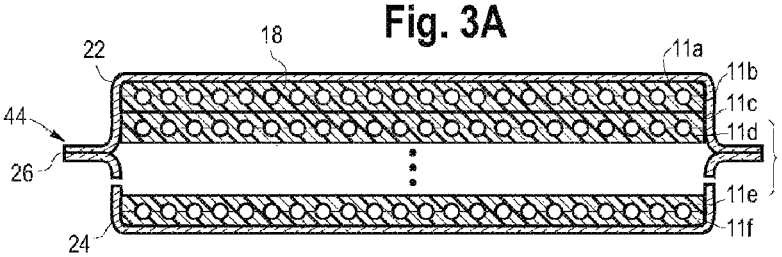
FIG. 3A is a sectional view of a microcapillary strip in accordance with an embodiment of the present disclosure.

FIGS. 1-3A depict various views of a microcapillary strip 10 (or strip 10). The microcapillary strip 10 is composed of multiple layers (11*a*, 11*b*) of a polymeric material. While only two layers (11*a*, 11*b*) are depicted in FIG. 3, the microcapillary strip 10 may include one, or three, or four, or five, or six, or more layers 11*a*-11*f*, as shown in FIG. 3A.

As shown in FIGS. 2 and 3, the microcapillary strip 10 has void volumes 12 and a first end 14 and a second end 16. The microcapillary strip 10 is composed of a matrix 18, which is a polymeric material. The matrix 18 may comprise reciprocal layers (such as layers 11*a*, 11*b*). Alternatively, matrix 18 may be an integral and uniform polymeric material made by way of in situ microcapillary strip production as disclosed in copending application U.S. Ser. No. 62/185,939 filed on 29 Jun. 2015, the entire content of which is incorporated by reference herein.

One or more channels 20 are disposed in the matrix 18. The channels 20 are arranged alongside and extend from the first end 14 to the second end 16 of the microcapillary strip 10. The channels 20 are positioned between the layers 11*a*, 11*b*. The number of channels 20 may be varied as desired. Each channel 20 has a cross-sectional shape. Nonlimiting examples of suitable cross-sectional shapes for the channels include oval, ovoid, circle, curvilinear, triangle, square, rectangle, star, diamond, and combinations thereof.

It is desired that the polymeric material has low shrink and release properties. In addition, it is recognized that a factor in the retention and/or ease of discharge of the liquid product stored in the flexible container is the surface tension between (i) the channel (or capillary) surfaces and (ii) the liquid content of the flexible container. Applicant discovered that altering the surface tension, or otherwise optimizing surface tension, for a particular use may improve performance of the flexible pouch. Nonlimiting examples of suitable methods to alter surface tension include material selection of the layers 11*a*, 11*b* and/or matrix 18, addition of surface coatings to the layers 11*a*, 11*b* and/or matrix 18, surface treatment of the layers 11*a*, 11*b* and/or matrix 18 and/or the resultant channels 20 (i.e., corona treatment), and addition of additives either to the layers 11*a*, 11*b* and/or matrix 18, or to the liquid to be stored in the flexible container.

The channels 20 have a diameter, D, as shown in FIG. 3. The term "diameter," as used herein, is the longest axis of the channel 20, from a cross-sectional view. In an embodiment, the diameter, D, is from 50 micrometer (μm), or 100 μm, or 150 μm, or 200 μm to 250 μm, or 300 μm, or 350 μm, or 400 μm, or 500 μm, or 600 μm, or 700 μm, or 800 μm, or 900 μm, or 1000 μm.

In an embodiment, the diameter, D, is from 300 μm, or 400 μm, or 500 μm to 600 μm, or 700 μm, or 800 μm, or 900 μm or 1000 μm.

The channels 20 may or may not be parallel with respect to each other. The term "parallel," as used herein, indicates the channels extend in the same direction and never intersect.

In an embodiment, the channels 20 are parallel.

In an embodiment, the channels 20 are not parallel, or are non-parallel.

A spacing, S, of matrix 18 (polymeric material) is present between the channels 20, as shown in FIG. 3. In an embodiment, the spacing, S, is from 1 micrometer (μm), or 5 μm, or 10 μm, or 25 μm, or 50 μm, or 100 μm, or 150 μm, or 200 μm to 250 μm, or 300 μm, or 350 μm, or 400 μm, or 500 μm, or 1000 μm, or 2000 μm or 3000 μm.

The microcapillary strip 10 has a thickness, T, and a width, W as shown in FIG. 3. In an embodiment, the thickness, T, is from 10 μm, or 20 μm, or 30, or 40 μm, or 50 μm, or 60 μm, or 70 μm, or 80 μm, or 90 μm, or 100 μm to 200 μm, or 500 μm, or 1000 μm, or 1500 μm, or 2000 μm.

In an embodiment, the short axis of the microcapillary strip 10 is from 20%, or 30%, or 40%, or 50% to 60% to 70% to 80% of the thickness, T. The "short axis" is the shortest axis of the channel 20 from the cross section point of view. The shortest axis is typically the "height" of the channel considering the microcapillary strip in a horizontal position.

In an embodiment, the microcapillary strip 10 has a thickness, T, from 50 μm, or 60 μm, or 70 μm, or 80 μm, or 90 μm, or 100 μm to 200 μm, or 500 μm, or 1000 μm, or 1500 μm, or 2000 μm. In a further embodiment, the microcapillary strip 10 has a thickness, T, from 600 μm to 1000 μm.

In an embodiment, the microcapillary strip 10 has a width, W, from 0.5 centimeter (cm), or 1.0 cm, or 1.5 cm, or 2.0 cm, or 2.5 cm, or 3.0 cm, or 5.0 cm to 8.0 cm, or 10.0 cm, or 20.0 cm, or 30.0 cm, or 40.0 cm, or 50.0 cm, or 60.0 cm, or 70.0 cm, or 80.0 cm, or 90.0 cm, or 100.0 cm.

In an embodiment, the microcapillary strip 10 has a width, W, from 0.5 cm, or 1.0 cm, or 2.0 cm to 2.5 cm, or 3.0 cm, or 4.0 cm, or 5.0 cm.

In an embodiment, the channels 20 have a diameter, D, from 300 μm to 1000 μm; the matrix 18 has a spacing, S, from 300 μm to 2000 μm; and the microcapillary strip 10 has a thickness, T, from 50 μm to 2000 μm and a width, W, from 1.0 cm to 4.0 cm.

The microcapillary strip 10 may comprise at least 10 percent by volume of the matrix 18, based on the total volume of the microcapillary strip 10; for example, the microcapillary strip 10 may comprise from 90 to 10 percent by volume of the matrix 18, based on the total volume of the microcapillary strip 10; or in the alternative, from 80 to 20 percent by volume of the matrix 18, based on the total volume of the microcapillary strip 10; or in the alternative, from 80 to 30 percent by volume of the matrix 18, based on the total volume of the microcapillary strip 10; or in the alternative, from 80 to 50 percent by volume of the matrix 18, based on the total volume of the microcapillary strip 10.

The microcapillary strip 10 may comprise from 10 to 90 percent by volume of voidage, based on the total volume of the microcapillary strip 10; for example, the microcapillary strip 10 may comprise from 20 to 80 percent by volume of voidage, based on the total volume of the microcapillary strip 10; or in the alternative, from 20 to 70 percent by volume of voidage, based on the total volume of the microcapillary strip 10; or in the alternative, from 20 to 50 percent by volume of voidage, based on the total volume of the microcapillary strip 10.

The matrix 18 is composed of one or more polymeric materials. Nonlimiting examples of suitable polymeric materials include ethylene/$C_3$-$C_{10}$ α-olefin copolymers linear or branched; ethylene/$C_4$-$C_{10}$ α-olefin copolymers linear or branched; propylene-based polymer (including plastomer and elastomer, random propylene copolymer, propylene homopolymer, and propylene impact copolymer); ethylene-based polymer (including plastomer and elastomer, high density polyethylene (HDPE); low density polyethylene (LDPE); linear low density polyethylene (LLDPE); medium density polyethylene (MDPE)); ethylene-acrylic acid or ethylene-methacrylic acid and their ionomers with zinc, sodium, lithium, potassium, magnesium salts; ethylene vinyl acetate copolymers; and blends thereof.

In an embodiment, the matrix 18 is composed of one or more of the following polymers: enhanced polyethylene resin ELITE™ 5100G with a density of 0.92 g/cc by ASTM D792, a Melt Index of 0.85 g/10 min@190° C., 2.16 kg by ASTM D1238, and melt temperature of 123° C.; low density polyethylene resin DOW™ LDPE 501I with a density of 0.922 g/cc by ASTM D792, a Melt Index of 1.9 g/10 min@190C, 2.16 kg, and a melting temperature of 111° C.; high density polyethylene resin UNIVAL™ DMDA-6400 NT7 with a density of 0.961 g/cc by ASTM D792, a Melt Index of 0.8 g/10 min@190° C., 2.16 kg, and a melting temperature of 111° C.; polypropylene Braskem™ PP H314-02Z with a density of 0.901 g/cc by ASTM D792, a Melt Index of 2.0 g/10 min@230° C., 2.16 kg, and a melting temperature of 163° C.; ethylene/$C_4$-$C_{12}$ α-olefin multi-block copolymer such INFUSE™ 9817, INFUSE™ 9500, INFUSE™ 9507, INFUSE™ 9107, and INFUSE™ 9100 available from The Dow Chemical Company.

2. Flexible Film

The present flexible pouch includes opposing flexible films. In an embodiment, the flexible pouch includes two opposing flexible films 22, 24, as shown in FIGS. 2, 3 and 3A. Each flexible film can be a monolayer film or a multilayer film. The two opposing films may be components of a single (folded) sheet/web, or may be separate and distinct films. The composition and structure of each flexible film can be the same or can be different.

In an embodiment, the two opposing flexible films 22, 24 are components of the same sheet or film, wherein the sheet is folded upon itself to form the two opposing films. The three unconnected edges can then be sealed, or heat sealed, after the microcapillary strip is placed between the folded-over films.

In an embodiment, each flexible film 22, 24 is a separate film and is a flexible multilayer film having at least one, or at least two, or at least three layers. The flexible multilayer film is resilient, flexible, deformable, and pliable. The structure and composition for each of the two flexible multilayer films may be the same or different. For example, each of the two flexible films can be made from a separate web, each web having a unique structure and/or unique composition, finish, or print. Alternatively, each of two flexible films 22, 24 can be the same structure and the same composition, or from a single web.

In an embodiment, flexible film 22 and flexible film 24 each is a flexible multilayer film having the same structure and the same composition from a single web.

Each flexible multilayer film 22, 24 may be (i) a coextruded multilayer structure, (ii) a laminate, or (iii) a combination of (i) and (ii). In an embodiment, each flexible multilayer film 22, 24 has at least three layers: a seal layer, an outer layer, and a tie layer between. The tie layer adjoins the seal layer to the outer layer. The flexible multilayer film may include one or more optional inner layers disposed between the seal layer and the outer layer.

In an embodiment, the flexible multilayer film is a coextruded film having at least two, or three, or four, or five, or six, or seven to eight, or nine, or ten, or eleven, or more layers. Some methods, for example, used to construct films are by cast co-extrusion or blown co-extrusion methods, adhesive lamination, extrusion lamination, thermal lamination, and coatings such as vapor deposition. Combinations of these methods are also possible. Film layers can comprise, in addition to the polymeric materials, additives such as stabilizers, slip additives, antiblocking additives, process aids, clarifiers, nucleators, pigments or colorants, fillers and reinforcing agents, and the like as commonly used in the packaging industry. It is particularly useful to choose additives and polymeric materials that have suitable organoleptic and or optical properties.

The flexible multilayer film is composed of one or more polymeric materials. Nonlimiting examples of suitable polymeric materials for the seal layer include olefin-based polymer including any ethylene/$C_3$-$C_{10}$ α-olefin copolymers linear or branched; ethylene/$C_4$-$C_{10}$ α-olefin copolymers linear or branched; propylene-based polymer (including plastomer and elastomer; and random propylene copolymer); ethylene-based polymer (including plastomer and elastomer, high density polyethylene (HDPE); low density polyethylene (LDPE); linear low density polyethylene (LLDPE); medium density polyethylene (MDPE)); ethylene-acrylic acid, ethylene vinyl acetate, or ethylene-methacrylic acid and their ionomers with zinc, sodium, lithium, potassium, magnesium salts; ethylene vinyl acetate copolymers; and blends thereof.

Nonlimiting examples of suitable polymeric material for the outer layer include those used to make biaxially or monoaxially oriented films for lamination as well as coextruded films. Some nonlimiting polymeric material examples are biaxially oriented polyethylene terephthalate (OPET), monoaxially oriented nylon (MON), biaxially oriented nylon (BON), and biaxially oriented polypropylene (BOPP). Other polymeric materials useful in constructing film layers for structural benefit are polypropylenes (such as propylene homopolymer, random propylene copolymer, propylene impact copolymer, thermoplastic polypropylene (TPO) and the like, propylene-based plastomers (e.g., VERSIFY™ or VISTAMAX™)), polyamides (such as Nylon 6; Nylon 6,6; Nylon 6,66; Nylon 6,12; Nylon 12; etc.), polyethylene norbornene, cyclic olefin copolymers, polyacrylonitrile, polyesters, copolyesters (such as polyethylene terephthlate glycol-modified (PETG)), cellulose esters, polyethylene and copolymers of ethylene (e.g., LLDPE based on ethylene octene copolymer such as DOWLEX™), blends thereof, and multilayer combinations thereof.

Nonlimiting examples of suitable polymeric materials for tie layer include functionalized ethylene-based polymers such as ethylene-vinyl acetate (EVA) copolymer; polymers with maleic anhydride-grafted to polyolefins such as any polyethylene, ethylene-copolymers, or polypropylene; and ethylene acrylate copolymers such an ethylene methyl acrylate (EMA); glycidyl containing ethylene copolymers; propylene and ethylene based olefin block copolymers such as INFUSE™ (ethylene-based Olefin Block Copolymers available from the Dow Chemical Company) and INTUNE™ (PP-based Olefin Block Copolymers available from The Dow Chemical Company); and blends thereof.

The flexible multilayer film may include additional layers which may contribute to the structural integrity or provide specific properties. The additional layers may be added by direct means or by using appropriate tie layers to the adjacent polymer layers. Polymers which may provide additional performance benefits such as stiffness, toughness or opacity, as well polymers which may offer gas barrier properties or chemical resistance can be added to the structure.

Nonlimiting examples of suitable material for the optional barrier layer include copolymers of vinylidene chloride and methyl acrylate, methyl methacrylate or vinyl chloride (e.g., SARAN™ resins available from The Dow Chemical Company); vinylethylene vinyl alcohol (EVOH) copolymer; and metal foil (such as aluminum foil). Alternatively, modified polymeric films such as vapor deposited aluminum or silicon oxide on such films as BON, OPET, or OPP, can be used to obtain barrier properties when used in laminate multilayer film.

In an embodiment, the flexible multilayer film includes a seal layer selected from LLDPE (sold under the trade name DOWLEX™ (The Dow Chemical Company)); single-site LLDPE substantially linear, or linear ethylene alpha-olefin copolymers, including polymers sold under the trade name AFFINITY™ or ELITE™ (The Dow Chemical Company) for example; propylene-based plastomers or elastomers such as VERSIFY™ (The Dow Chemical Company); and blends thereof. An optional tie layer is selected from either ethylene-based olefin block copolymer INFUSE™ Olefin Block Copolymer (available from The Dow Chemical Company) or propylene-based olefin block copolymer such as INTUNE™ (available from The Dow Chemical Company), and blends thereof. The outer layer includes greater than 50 wt % of resin(s) having a melting point, Tm, that is from 25° C. to 30° C., or 40° C. higher than the melting point of the polymer in the seal layer wherein the outer layer polymer is comprised of resins such as DOWLEX™ LLDPE, ELITE™ enhanced polyethylene resin, MDPE, HDPE, or a propylene-based polymer such as VERSIFY™, VISTAMAX™, propylene homopolymer, propylene impact copolymer, or TPO.

In an embodiment, the flexible multilayer film is coextruded.

In an embodiment, flexible multilayer film includes a seal layer selected from LLDPE (sold under the trade name DOWLEX™ (The Dow Chemical Company)); single-site LLDPE (substantially linear, or linear, olefin polymers, including polymers sold under the trade name AFFINITY™ or ELITE™ (The Dow Chemical Company) for example); propylene-based plastomers or elastomers such as VERSIFY™ (The Dow Chemical Company); and blends thereof. The flexible multilayer film also includes an outer layer that is a polyamide.

In an embodiment, the flexible multilayer film is a coextruded film and includes:

(i) a seal layer composed of an olefin-based polymer having a first melt temperature less than 105° C., (Tm1); and (ii) an outer layer composed of a polymeric material having a second melt temperature, (Tm2), wherein Tm2−Tm1>40° C.

The term "Tm2−Tm1" is the difference between the melt temperature of the polymer in the outer layer and the melt temperature of the polymer in the seal layer, and is also referred to as "ΔTm." In an embodiment, the ΔTm is from 41° C., or 50° C., or 75° C., or 100° C. to 125° C., or 150° C., or 175° C., or 200° C.

In an embodiment, the flexible multilayer film is a coextruded film; the seal layer is composed of an ethylene-based polymer, such as a linear or a substantially linear polymer, or a single-site catalyzed linear or substantially linear polymer of ethylene and an alpha-olefin monomer such as 1-butene, 1-hexene or 1-octene, having a Tm from 55° C. to 115° C. and a density from 0.865 to 0.925 g/cc, or from 0.875 to 0.910 g/cc, or from 0.888 to 0.900 g/cc; and the outer layer is composed of a polyamide having a Tm from 170° C. to 270° C.

In an embodiment, the flexible multilayer film is a coextruded and/or laminated film having at least five layers, the coextruded film having a seal layer composed of an ethylene-based polymer, such as a linear or substantially linear polymer, or a single-site catalyzed linear or substantially linear polymer of ethylene and an alpha-olefin comonomer such as 1-butene, 1-hexene or 1-octene, the ethylene-based polymer having a Tm from 55° C. to 115° C. and a density from 0.865 to 0.925 g/cc, or from 0.875 to 0.910 g/cc, or from 0.888 to 0.900 g/cc and an outermost layer composed of a material selected from LLDPE, OPET, OPP (oriented polypropylene), BOPP, polyamide, and combinations thereof.

In an embodiment, the flexible multilayer film is a coextruded and/or laminated film having at least seven layers. The seal layer is composed of an ethylene-based polymer, such as a linear or substantially linear polymer, or a single-site catalyzed linear or substantially linear polymer of ethylene and an alpha-olefin comonomer such as 1-butene, 1-hexene or 1-octene, the ethylene-based polymer having a Tm from 55° C. to 115° C. and density from 0.865 to 0.925 g/cc, or from 0.875 to 0.910 g/cc, or from 0.888 to 0.900 g/cc. The outer layer is composed of a material selected from LLDPE, OPET, OPP (oriented polypropylene), BOPP, polyamide, and combinations thereof.

In an embodiment, the flexible multilayer film is a coextruded (or laminated) five layer film, or a coextruded (or laminated) seven layer film having at least two layers containing an ethylene-based polymer. The ethylene-based polymer may be the same or different in each layer.

In an embodiment, the flexible multilayer film is a coextruded (or laminated) five layer film, or a coextruded (or laminated) seven layer film having all layers containing polyolefin. The polyolefins may be the same or different in each layer. In such a case the entire package created with microcapillary strip included contains polyolefin.

In an embodiment, the flexible multilayer film is a coextruded (or laminated) five layer film, or a coextruded (or laminated) seven layer film having all layers containing an ethylene-based polymer. The ethylene-based polymer may be the same or different in each layer. In such a case the entire package created with microcapillary strip included contains polyethylene.

In an embodiment, the flexible multilayer film includes a seal layer composed of an ethylene-based polymer, or a linear or substantially linear polymer, or a single-site catalyzed linear or substantially linear polymer of ethylene and an alpha-olefin monomer such as 1-butene, 1-hexene or 1-octene, having a heat seal initiation temperature (HSIT) from 65° C. to less than 125° C. Applicant discovered that the seal layer with an ethylene-based polymer with a HSIT from 65° C. to less than 125° C. advantageously enables the formation of secure seals and secure sealed edges around the complex perimeter of the flexible container. The ethylene-based polymer with HSIT from 65° C. to 125° C. enables lower heat sealing pressure/temperature during container fabrication. Lower heat seal pressure/temperature results in lower stress at the fold points of the gusset, and lower stress at the union of the films in the top segment and in the bottom segment. This improves film integrity by reducing wrinkling during the container fabrication. Reducing stresses at the folds and seams improves the finished container mechanical performance. The low HSIT ethylene-based polymer seals at a temperature below what would cause the microcapillary strip dimensional stability to be compromised.

In an embodiment, the flexible multilayer film is a coextruded and/or laminated five layer, or a coextruded (or laminated) seven layer film having at least one layer containing a material selected from LLDPE, OPET, OPP (oriented polypropylene), BOPP, and polyamide.

In an embodiment, the flexible multilayer film is a coextruded and/or laminated five layer, or a coextruded (or laminated) seven layer film having at least one layer containing OPET or OPP.

In an embodiment, the flexible multilayer film is a coextruded (or laminated) five layer, or a coextruded (or laminated) seven layer film having at least one layer containing polyamide.

In an embodiment, the flexible multilayer film is a seven-layer coextruded (or laminated) film with a seal layer composed of an ethylene-based polymer, or a linear or substantially linear polymer, or a single-site catalyzed linear or substantially linear polymer of ethylene and an alpha-olefin monomer such as 1-butene, 1-hexene or 1-octene, having a Tm from 90° C. to 106° C. The outer layer is a polyamide having a Tm from 170° C. to 270° C. The film has a ΔTm from 40° C. to 200° C. The film has an inner layer (first inner layer) composed of a second ethylene-based polymer, different than the ethylene-based polymer in the seal layer. The film has an inner layer (second inner layer) composed of a polyamide the same or different to the polyamide in the outer layer. The seven layer film has a thickness from 100 micrometers to 250 micrometers.

In an embodiment, flexible films 22, 24 each has a thickness from 50 micrometers (μm), or 75 μm, or 100 μm, or 150 μm, or 200 μm to 250 μm, or 300 μm, or 350 μm, or 400 μm.

2. Common Peripheral Edge

The opposing flexible films 22 and 24 are superimposed on each other and form a common peripheral edge 26, as shown in FIGS. 1, 3A and 4-5. The common peripheral edge 26 defines a shape. The shape can be a polygon (such as triangle, square, rectangle, diamond, pentagon, hexagon, heptagon, octagon, etc.) or an ellipse (such as an ovoid, an oval, or a circle).

The microcapillary strip 10 is sealed between the opposing flexible films 22, 24 and forms a hermetic seal. The seal is formed by way of ultrasonic seal, heat seal, an combinations thereof. In an embodiment, the microcapillary strip 10 is sealed between the opposing flexible films 22, 24 by way of a heat sealing procedure. The term "heat sealing," as used herein, is the act of placing two or more films of polymeric material between opposing heat seal bars, the heat seal bars moved toward each other, sandwiching the films, to apply heat and pressure to the films such that opposing interior surfaces (seal layers) of the films contact, melt, and form a heat seal, or weld, to attach the films to each other. Heat sealing includes suitable structure and mechanism to move the seal bars toward and away from each other in order to perform the heat sealing procedure.

In an embodiment, the seal between the microcapillary strip 10 and the flexible films 22, 24 occurs at a first seal condition. The first seal condition is sufficient: (i) to fuse polymeric material of matrix 18 to the flexible films 22, 24 and form a hermetic seal between the microcapillary strip 10 and flexible films 22 and 24.

In an embodiment, the first heat seal condition includes a heat seal temperature that (1) is less than the melting temperature, Tm, of the polymeric material for the matrix 18 and (2) is greater than the heat seal initiation temperature seal layer for flexible films 22, 24.

A first side of the microcapillary strip is located at a first side of the common peripheral edge and a second side of the microcapillary strip is located at a second side of the common peripheral edge. In an embodiment, a first side 28 of the microcapillary strip 10 is located at a first side 30 of the common peripheral edge 26 for flexible pouch 2*a*, shown in FIG. 1. A second side 32 of the microcapillary strip 10 is located at a second side 34 of the common peripheral edge 26. As shown in FIG. 1, the second side 34 of the 4-sided polygon intersects the first side 30 of the 4-sided polygon, the intersection being corner 36 shown in FIG. 1. The microcapillary strip 10 has an outer edge 40 (corresponding to first end 14) and an inner edge 42 (corresponding to second end 16). In an embodiment, the outer edge 40 forms angle A at the corner 36, as shown in FIG. 1. In a further embodiment, angle A is 45°.

A peripheral seal 44 extends along at least a portion of the common peripheral edge 26. The peripheral seal 44 includes a sealed microcapillary segment either 46*a*, or 46*b*. The peripheral seal 44 can be a heat seal, an ultrasonic seal, an adhesive seal, and combinations thereof. In an embodiment, the peripheral seal 44 is a heat seal produced under a second seal condition. The second seal condition includes (1) a heat seal temperature that is greater than or equal to the Tm of the polymeric material of matrix 18 and (2) a seal pressure that collapses or otherwise crushes a portion of the channels 20 of the microcapillary strip 10.

In an embodiment, the second sealing is a heat sealing procedure and includes sealing, or otherwise forming, a peripheral seal 44 along a portion of the common peripheral edge 26. The resultant peripheral seal 44 includes a sealed microcapillary segment either 46*a* (FIGS. 4-5), or sealed microcapillary segment 46*b* (FIG. 5A).

Figure 5:
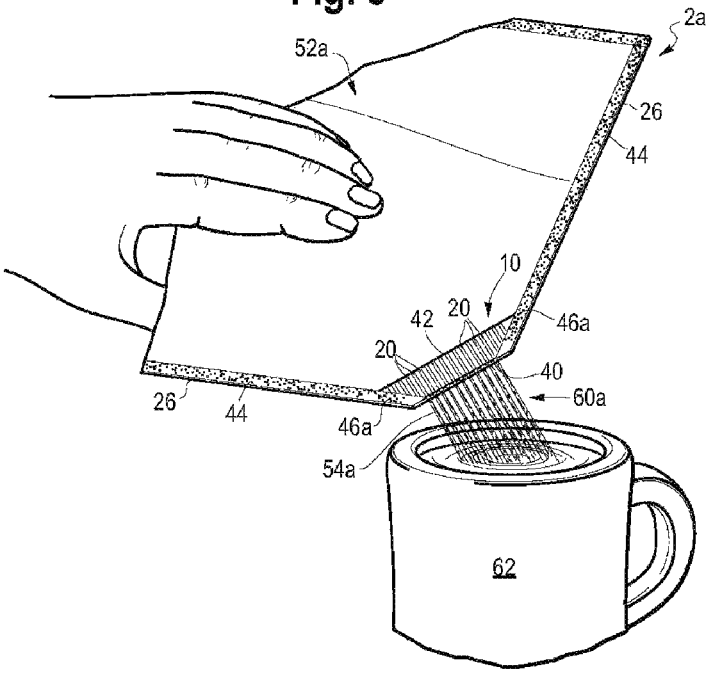
FIG. 5 a perspective view of a microcapillary dispensing from the flexible pouch in accordance with an embodiment of the present disclosure.
Figure 5A:
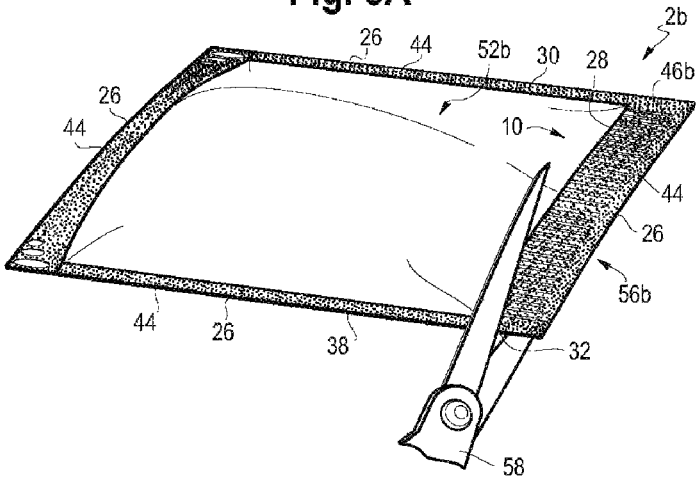
FIG. 5A is a perspective view of the removal of a release member in accordance with an embodiment of the present disclosure.
Figure 5B:
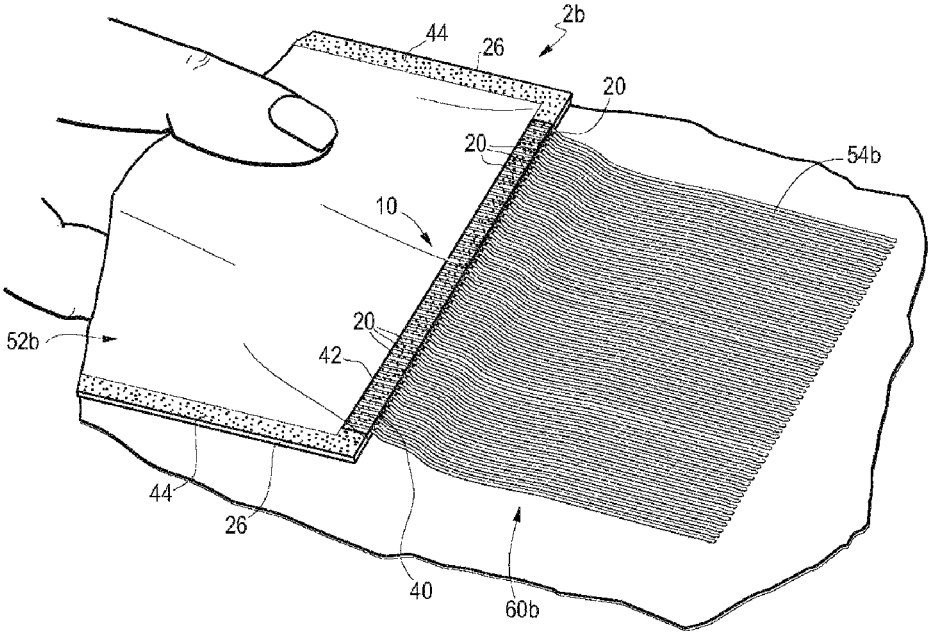
FIG. 5B a perspective view of microcapillary dispensing from the flexible pouch in accordance with an embodiment of the present disclosure.

In an embodiment shown in FIGS. 5A-5B, a flexible pouch 2*b* includes the common peripheral edge 26 which defines a polygon, such as a 4-sided polygon (rectangle, square, diamond). In this embodiment, the first side 28 of the microcapillary strip 10 is located at a first side 30 of the 4-sided polygon. The second side 32 of the microcapillary strip 10 is located at a parallel second side 38 of the 4-sided polygon. As shown in FIGS. 5A-5B, the first side 30 of the 4-sided polygon is parallel to, and does not intersect, the second side 38 of the 4-sided polygon.

The microcapillary strip 10 may or may not extend along the entire length of one side of the polygon. FIGS. 5A and 5B show microcapillary strip 10 extending along only a portion of the length of one side of the polygon.

Flexible pouches 2*a*, 2*b* each have a respective storage compartment 52*a*, 52*b*. As the first film 22 and the second film 24 are flexible, so too is each pouch 2*a*, 2*b* a flexible pouch.

In an embodiment, a fill inlet is located on the common peripheral edge 26. The fill inlet is closable and permits filling of the storage compartment 52*a* with a liquid 54*a* (for pouch 2*a*). Alternatively, a portion of the common peripheral edge 26 remains unsealed and a fill member adds liquid 54*a* into the storage compartment 52*a*. After the storage compartment 52*a* is filled with liquid 54*a*, the unsealed portion of the common peripheral edge 26 is subsequently sealed to form a sealed and closed flexible pouch 2*a*. The flexible pouch 2*b* can be filled with a liquid 54*b* in a similar manner.

The peripheral seal 44 forms a hermetic seal around the periphery of flexible pouch 2*a* and 2*b*. Each of flexible pouch 2*a* and 2*b* is a sealed and closed flexible pouch. The peripheral seal 44 forms a sealed and closed flexible pouch 2*a* and/or 2*b* each pouch having a storage compartment 52*a*, 52*b*. In an embodiment, a liquid 54*a*, 54*b* is present in the storage compartment 52*a*, 52*b*. Nonlimiting examples of suitable liquids 54*a*, 54*b* include fluid comestibles (beverages, condiments, salad dressings, flowable food); liquid or fluid medicaments; aqueous plant nutrition; household and industrial cleaning fluids; disinfectants; moisturizers; lubricants; surface treatment fluids such as wax emulsions, polishers, floor and wood finishes; personal care liquids (such as oils, creams, lotions, gels); etc.

3. Release Member

In an embodiment, the flexible pouch includes a release member. The release member includes a portion of the sealed microcapillary segment. Removal of the release member from the flexible pouch exposes the channels of the microcapillary strip.

The release member is a detachable portion of the flexible pouch. The release member can be completely (or wholly) detached from the flexible pouch. Alternatively, the release member can be partially detached, with a portion of the release member remaining attached to the flexible pouch. The purpose of the release member is two-fold. First, the release member blocks, or otherwise prevents, the flow of liquid from the storage compartment during storage of the flexible pouch. Second, detachment, or removal, of the release member from the flexible pouch exposes the channels, and thereby enables dispensing of the liquid from the flexible pouch through the microcapillary strip.

Figure 4:
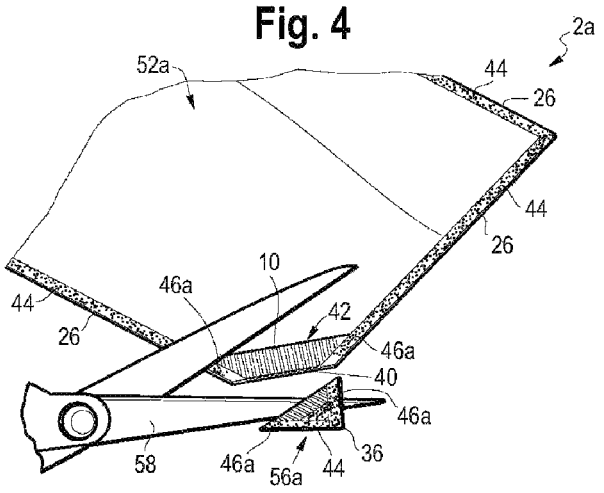
FIG. 4 is a perspective view of the removal of a release member in accordance with an embodiment of the present disclosure.

FIGS. 4 and 5A show the detachment of release member 56*a*, 56*b* from respective flexible pouches 2*a*, 2*b*. Detachment is actuated by way of hand (manually), tool, machine, and combinations thereof. In an embodiment, the release member 56*a*, 56*b* is detached manually (by hand) from respective flexible pouch 2*a*, 2*b*, with a person cutting a respective portion of the sealed microcapillary segment 46*a*, 46*b* with a sharp object such as a blade, a knife, or a scissors 58, as shown in FIGS. 4 and 5A.

As shown in FIG. 4, detachment of the release member 56*a* removes a portion of the sealed microcapillary segment 46*a* and exposes the outer edge 40 of the microcapillary strip 10 to the external environment. Once a portion of the sealed microcapillary segment 46*a*, is removed from the pouch 2*a*, the exposed channels 20 place the interior of storage compartment 52*a* in fluid communication with exterior of the flexible pouch 2*a*. Detachment of the release member 56*b* (FIG. 5A) from the flexible pouch 2*b* removes a portion of the sealed microcapillary segment 46*b* to expose channels 20 in a similar manner.

In an embodiment, the flexible pouch includes a squeezing force (or a compression force) imparted upon the storage compartment. A flow of the liquid passes through the exposed channels of the microcapillary strip and passes out of the flexible pouch.

In an embodiment, a person's hand imparts a squeezing force upon the storage compartment 52*a* (or 52*b*), as shown in FIGS. 5 and 5B. The squeezing force dispenses the liquid (54*a*, 54*b*) through the channels 20 and out of respective pouches 2*a*, 2*b*.

In an embodiment, a squeezing force imparted with a person's hand on the storage compartment 52*a* dispenses a spray pattern 60*a* of the liquid 54*a* from the flexible pouch 2*a*, as shown in FIG. 5. The spray pattern 60*a* can be advantageously controlled by adjusting the amount of squeeze force imparted upon the storage compartment 52*a*. In this way, the flexible pouch 2*a* surprisingly delivers a controlled spray pattern 60*a* of liquid 54*a* without the need for a rigid spray component. The profile of spray 60*a* can be designed by the configuration of the channels 20 in the microcapillary strip 10. Channels 20 with a relatively smaller diameter, D, will dispense a fine spray of the liquid 54*a* when compared to channels 20 with a relatively larger diameter, D. FIG. 5 shows the dispensing of a low viscosity liquid 56*a* (such as a water-based beverage) as a fine and controlled spray 60*a* and received in a container 62 (such as a cup).

In an embodiment, a squeezing force imparted with a person's hand on the storage compartment 52*b* dispenses a flow pattern 60*b* of the liquid 54*b*, as shown in FIG. 5B. The flow pattern 60*b* can be advantageously controlled by adjusting the amount of squeeze force imparted upon the storage compartment 52*b*. In this way, the flexible pouch 50*b* surprisingly delivers a controlled application of liquid 54*b* without the need for a rigid spray component. The diameter, D, of the channels 20 are configured so the profile of spray 60*b* delivers, or otherwise dispenses, a smooth and even application of a viscous liquid 56*b*, such as a high viscosity liquid, a lotion or a cream, onto a surface, such as a person's skin, as shown in FIG. 5B.

4. Edge Offset Distance

The present disclosure provides another flexible pouch. In an embodiment, a flexible pouch is provided and includes opposing flexible films. The opposing flexible films define a common peripheral edge. A microcapillary strip is located at an edge offset distance between the opposing flexible films. The microcapillary strip is sealed between the opposing flexible films. A first side of the microcapillary strip is located at a first side of the common peripheral edge and a second side of the microcapillary strip is located at a second side of the common peripheral edge. A peripheral seal extends along at least a portion of the common peripheral edge.

In an embodiment, the peripheral seal includes a sealed microcapillary segment.

Flexible pouch 102 (FIGS. 6-8), flexible pouch 102*a* (FIG. 8A), flexible pouch 202 (FIGS. 9-10), and flexible pouch 302 (FIGS. 11-13) each include a microcapillary strip located at an edge offset distance. The edge offset distance, or EOD, is a length from the common peripheral edge to an interior portion of the flexible films. The edge offset distance, EOD, can be from greater than zero millimeter (mm), or 1 mm, or 1.5 mm, or 2.0 mm, or 2.5 mm, or 3.0 mm, or 3.5 mm to 4.0 mm, or 4.5 mm, or 5.0 mm, or 6.0 mm, or 7.0 mm, or 9.0 mm, or 10.0 mm, or 15.0 mm, or 20.0 mm, or 40.0 mm, or 60.0 mm, or 80.0 mm, or 90.0 mm, or 100.0 mm.

Figure 6:
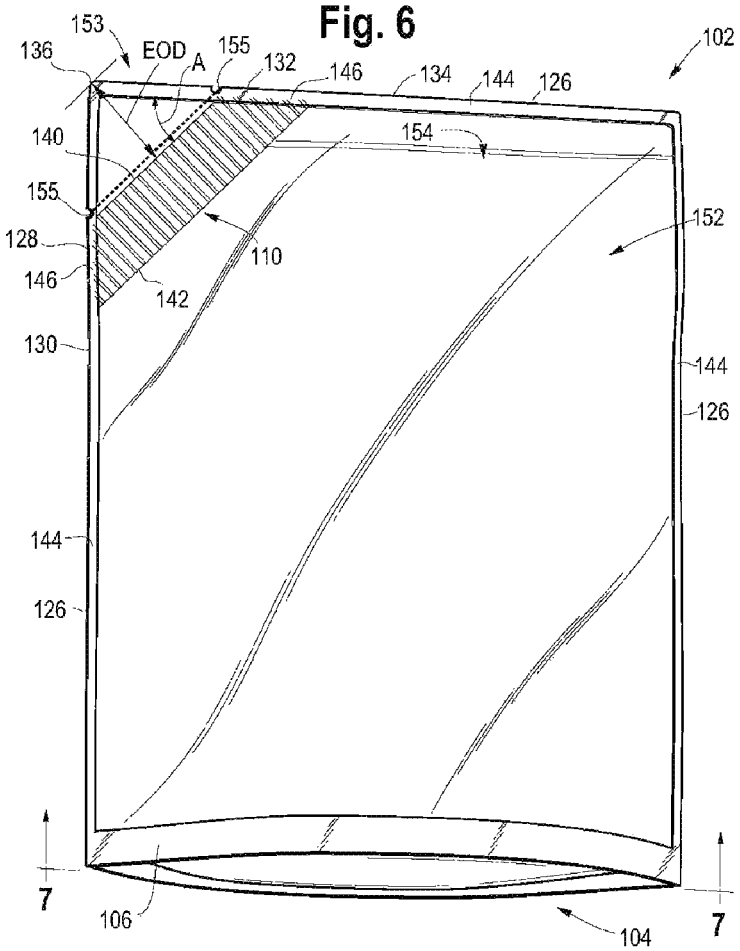
FIG. 6 is a perspective view of a flexible pouch with a microcapillary dispensing system in accordance with another embodiment of the present disclosure.
Figure 7:
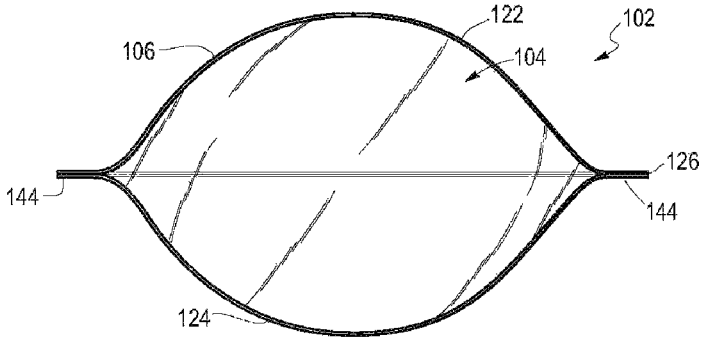
FIG. 7 is a sectional view taken along line 7-7 of FIG. 6.
Figure 8:
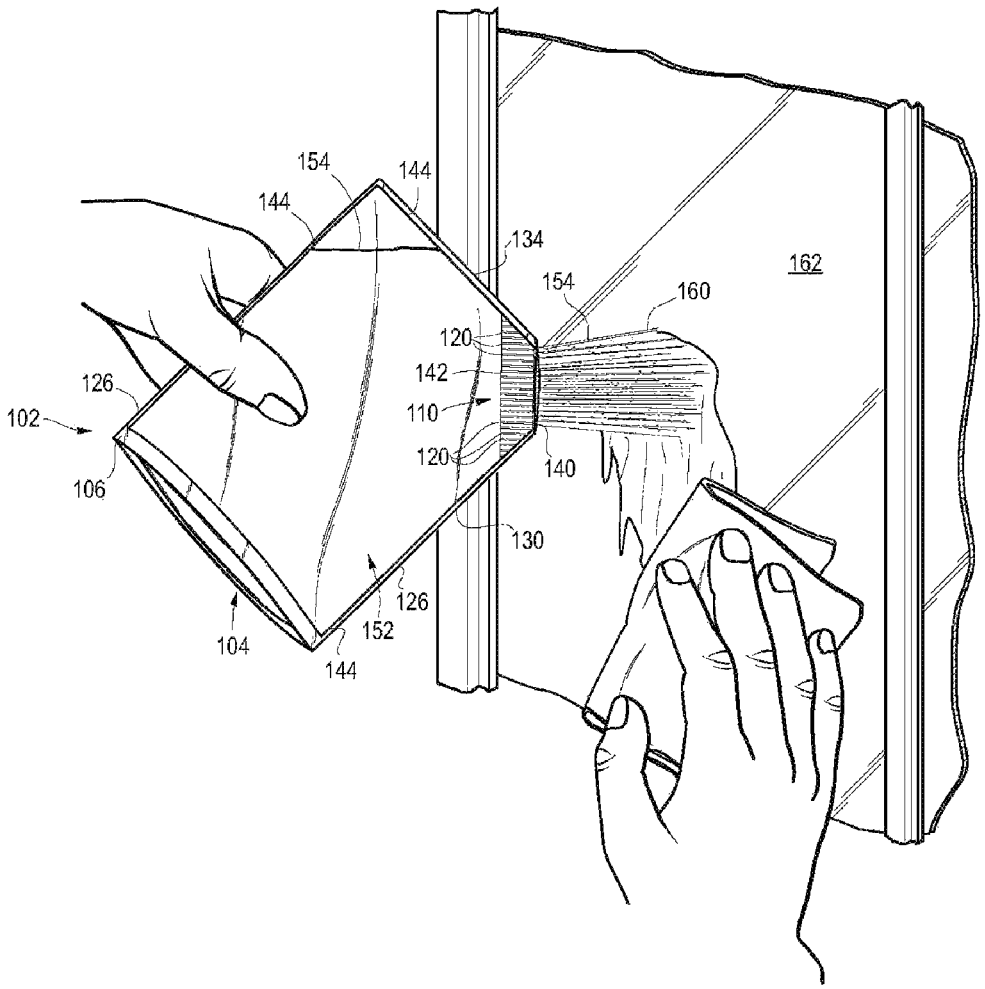
FIG. 8 is a perspective view of microcapillary dispensing from the flexible pouch in accordance with another embodiment of the present disclosure.

FIGS. 6-8 show an embodiment, wherein the flexible pouch is flexible stand-up pouch (or SUP) 102. The SUP 102 includes first flexible film 122, second flexible film 124, and a gusset panel 104. The gusset panel 104 joins the first flexible film 122 to the second flexible film 124 along a bottom of the pouch. The flexible films 122, 124 and the gusset panel 104 form a hermetically sealed storage compartment 152.

The gusset panel 104 is made from the same material as the flexible films 122, 124. The gusset panel 104 joins the flexible film 122 to the flexible film 124 along a bottom of the pouch to form a base for the flexible pouch. The gusset panel 104 includes a gusset rim 106. The gusset rim 106 supports the flexible pouch 102 and enables the flexible pouch to stand in an upright position. The gusset panel 104 is formed by folding, shaping, and sealing a portion of the first flexible film 122 with a portion of the second flexible film 124. Nonlimiting procedures for joining the gusset panel 104 and the flexible films 122, 124 include heat seal, ultrasonic seal, impulse, radio frequency (RF) sealing, weld, adhesive seal, and combinations thereof.

The flexible films 122, 124 define a common peripheral edge 126 as previously disclosed herein. The microcapillary strip 110 is placed at an edge offset distance, EOD, between opposing flexible films 122, 124. The distance from the corner 136 to the outer edge 140 of the microcapillary strip, is the edge offset distance shown as length EOD in FIG. 6. The EOD is perpendicular to outer edge 140. In an embodiment, the EOD is from greater than 0 mm, or 1.0 mm, or 1.5 mm, or 2.0 mm, or 3.0 mm, or 4.0 mm, or 5.0 mm, or 10.0 mm to 15.0 mm, or 20.0 mm, or 25.0 mm, or 30 mm.

The common peripheral edge 126 defines a 4-sided polygon (rectangle, square, diamond). In an embodiment, the first side 128 of the microcapillary strip 110 is located at a first side 130 of the 4-sided polygon. The second side 132 of the microcapillary strip 110 is located at an intersecting second side 134 of the 4-sided polygon. As shown in FIGS. 6 and 8, the second side 134 of the 4-sided polygon intersects the first side 130 of the 4-sided polygon, the intersection being corner 136.

The microcapillary strip 110 has an outer edge 140 and an inner edge 142. In an embodiment, the outer edge 140 forms angle A at the corner 136, as shown in FIG. 6. In a further embodiment, angle A is 45°.

The microcapillary strip 110, located at the edge offset distance, forms a storage compartment 152 and a corner pocket 153 shown in FIG. 6. The microcapillary strip 110 separates the storage compartment 152 from the corner pocket 153. A peripheral seal 144 forms a closed and sealed flexible pouch 102. The peripheral seal 144 includes at least one sealed microcapillary segment 146.

The corner pocket 153 functions as the release member for the pouch 102. Hence, the corner pocket 153 is a detachable portion of the flexible pouch 102. The corner pocket 153 has the same two-fold purpose as previously discussed for the release member. Since the corner pocket 153 is the result of the edge offset distance between the microcapillary strip 110 and the common peripheral edge 126, the corner pocket 153 may or may not include a portion of the sealed microcapillary segment 146.

In an embodiment, the corner pocket 153 includes a portion of the peripheral seal 144 but does not include a portion of the sealed microcapillary segment 146.

In an embodiment, the pocket 153 includes cut-outs (or notches) 155 in the peripheral seal 144. Cut-outs 155 enable ready removal of the corner pocket 153. In this way, corner pocket 153 enables, or otherwise promotes, tearing, by hand, the corner pocket 153 from the flexible pouch 102. It is understood corner pocket 153 also may be removed by cutting with a blade or scissors, for example.

In an embodiment, a squeezing force is imparted by hand upon the storage compartment 152. The squeezing force dispenses liquid 154 through the exposed channels 120 and out of the flexible pouch 102. The exposed channels 120 dispense a spray pattern 160 of the liquid 154, as shown in FIG. 8. FIG. 8 shows the dispensing of a low viscosity liquid 154 (such as a water-based cleaning solution) as a fine and controlled spray. The spray pattern 160 and the spray flow intensity can be advantageously controlled by adjusting the amount of squeeze force imparted upon the storage compartment 152 as previously discussed. In this way, the flexible pouch 102 surprisingly and advantageously provides a flexible pouch and dispensing system that can be operated entirely by hand—i.e., hand removal of corner pocket 153, hand control (squeeze) of spray pattern 160, and hand operation of the wiping of a surface to be cleaned 162.

Figure 8A:
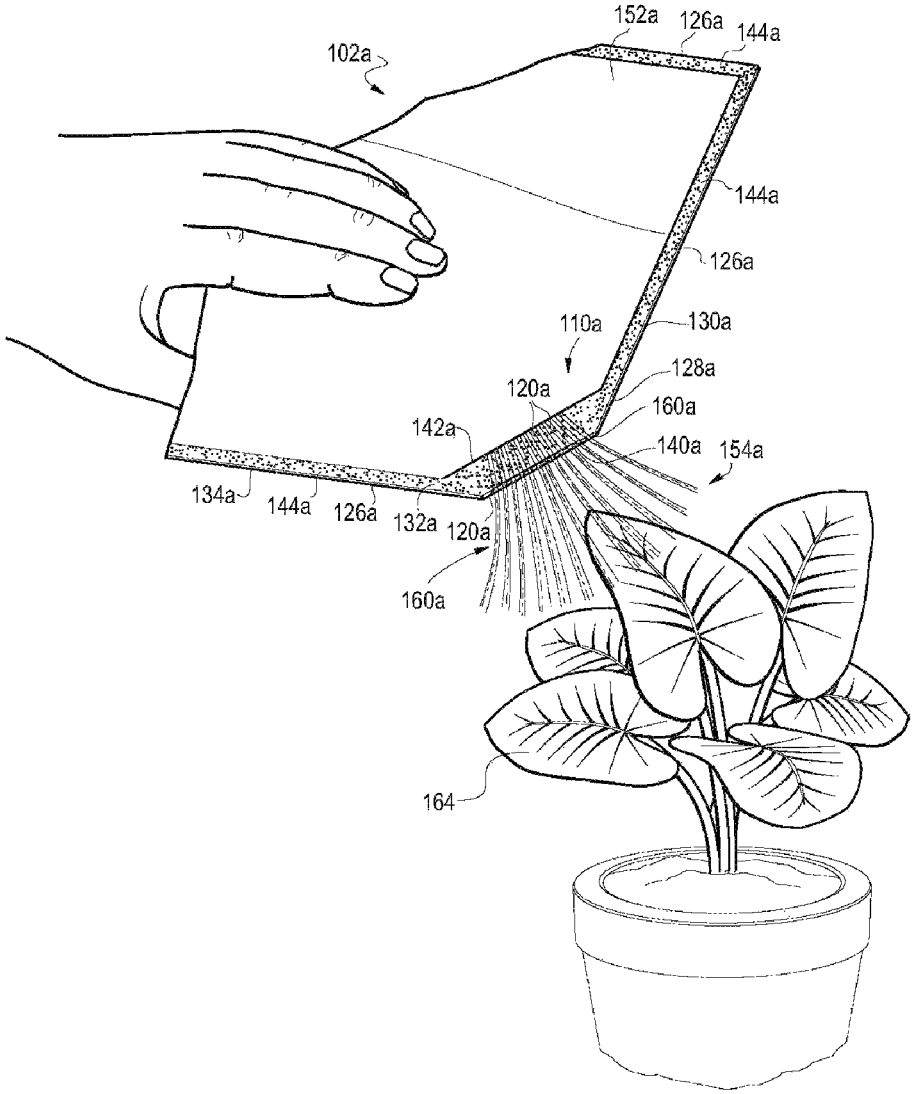
FIG. 8A is a perspective view of microcapillary dispensing with non-parallel channels in accordance with an embodiment of the present disclosure.

FIG. 8A provides an embodiment, wherein the flexible pouch includes a microcapillary strip 110*a* having non-parallel channels 120*a*, an outer edge 140*a* and an inner edge 142*a*. Stand-up pouch 102*a* includes common peripheral edge 126*a* which defines a 4-sided polygon (rectangle, square, diamond). In an embodiment, the first side 128*a* of the microcapillary strip 110*a* is located at a first side 130*a* of the 4-sided polygon. The second side 132*a* of the microcapillary strip 110*a* is located at an intersecting second side 134*a* of the 4-sided polygon. Stand-up pouch 102*a* includes a peripheral seal 144*a*.

In FIG. 8A, the microcapillary strip 110*a* includes non-parallel channels 120*a*. With the release member (a pocket 153*a*, not shown), removed, a squeezing force imparted by a person's hand upon storage compartment 152*a* dispenses liquid 154*a* through the exposed non-parallel channels 120*a* and out of the flexible pouch 102*a*. The non-parallel channels 120*a* are exposed along the outer edge 140*a* and are configured to dispense a fan spray pattern 160*a* of the liquid 154*a*, as shown in FIG. 8A. When compared to the spray profile 160 (FIG. 8), the fan spray 160*a* (FIG. 8A) delivers a disperse, or otherwise wide area (fan) spray pattern 160*a*. The fan spray pattern 160*a* is suitable for many applications. An nonlimiting application for fan spray pattern 160*a* is for watering a plant 164, as shown in FIG. 8A.

Figure 9:
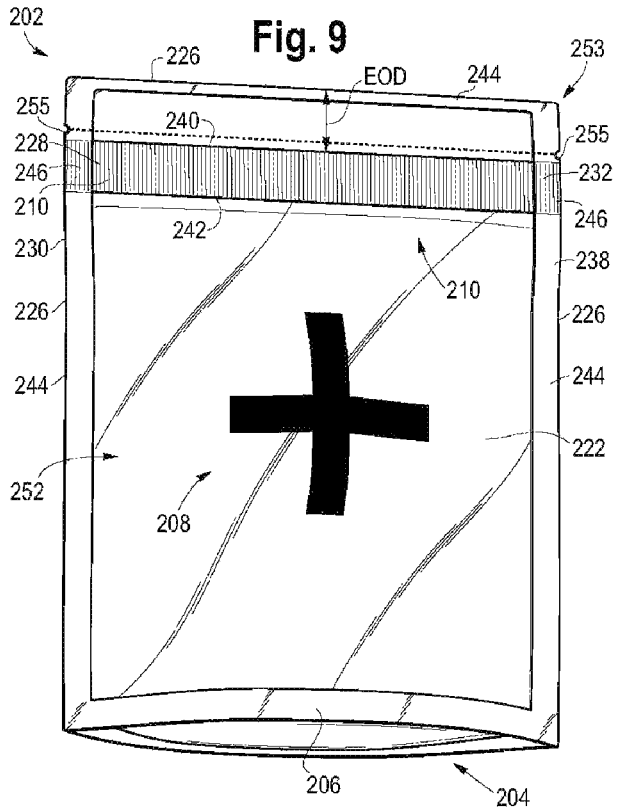
FIG. 9 is a perspective view of a flexible pouch with a microcapillary dispensing system in accordance with another embodiment of the present disclosure.
Figure 10:
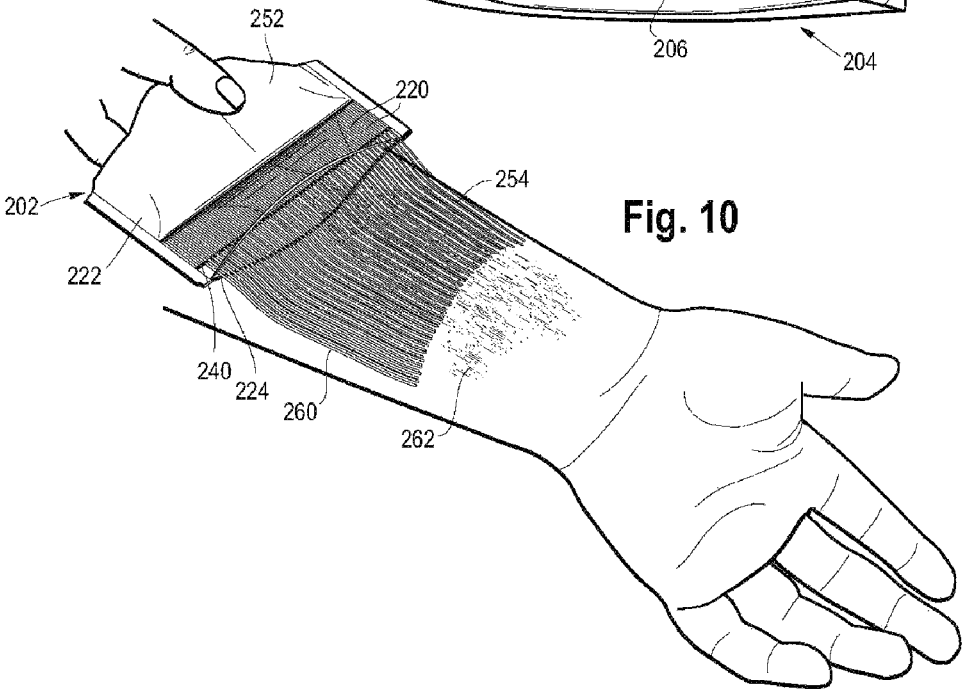
FIG. 10 is a perspective view of microcapillary dispensing in accordance with another embodiment of the present disclosure.

FIGS. 9-10 provide an embodiment wherein the flexible pouch is a flexible stand-up pouch (or SUP) 202. The SUP 202 includes first flexible film 222, second flexible film 224, a gusset panel 204, and a gusset rim 206. The gusset panel 204 includes gusset rim 206 and can be any gusset panel as previously discussed herein. The gusset panel 204 joins the first flexible film 222 to the second flexible film 224 as previously discussed. The flexible films 222, 224 and the gusset panel 204 form a hermetically sealed storage compartment 252.

An indicia 208 can be printed, or otherwise applied, on the outer surface of flexible film 222 and/or flexible film 224. The indicia 208 can be marketing or branding content, or can be information related to, or otherwise describing, the contents of the SUP 202, such as a cross designating first aid or a medicament, as shown in FIG. 9.

The flexible films 222, 224 define a common peripheral edge 226 as previously disclosed herein. The microcapillary strip 210 is placed at an edge offset distance, EOD, between opposing flexible films 222, 224, as shown in FIG. 9.

The common peripheral edge 226 defines a 4-sided polygon (rectangle, square, diamond). In an embodiment, the first side 228 of the microcapillary strip 210 is located at a first side 230 of the 4-sided polygon. The second side 232 of the microcapillary strip 210 is located at a parallel second side 238 of the 4-sided polygon. As shown in FIG. 9, the second side 238 of the 4-sided polygon is parallel to, and does not intersect the first side 230 of the 4-sided polygon.

The microcapillary strip 210 has an outer edge 240 and an inner edge 242. The distance from the top common peripheral edge 226, to the outer edge 240 is the edge offset distance, shown as distance EOD in FIG. 9.

In an embodiment, the EOD is from greater than 0 mm to 30 mm.

In an embodiment, the EOD is from 1%, or 5%, or 10%, or 15%, or 20%, or 25% to 30%, or 35%, or 40%, or 45%, or 50% the length (the length being the distances from the top of the SUP to the gusset panel 204) of the SUP 202.

The microcapillary strip 210, located at the edge offset distance, EOD, forms a storage compartment 252 and a long pocket 253. The microcapillary strip 210 separates the storage compartment 252 from the long pocket 253. A peripheral seal 244 forms a closed and sealed flexible pouch 202. The peripheral seal 244 includes at least one sealed microcapillary segment 246.

The long pocket 253 functions as the release member for the pouch 202. Hence, the pocket 253 is a detachable portion of the flexible pouch 202. The long pocket 253 has the same two-fold purpose as previously discussed for the release member. Since the long pocket 253 is the result of the edge offset distance between the microcapillary strip 210 and the common peripheral edge 226, the long pocket 253 may or may not include a portion of the sealed microcapillary segment 246.

In an embodiment, the long pocket 253 includes a portion of the peripheral seal 244, but does not include a portion of the sealed microcapillary segment 246, as shown in FIG. 9.

In an embodiment, the long pocket 253 includes cut-outs (or notches) 255 in the peripheral seal 244. Cut-outs 255 enable ready removal of the long pocket 253. In this way, long pocket 253 enables, or otherwise promotes, tearing, by hand, the long pocket 253 from the flexible pouch 202.

In an embodiment, a squeezing force is imparted by hand upon the storage compartment 252. The squeezing force dispenses liquid 254 through outer edge 240 and through the exposed channels 220 and out of the pouch 202. The exposed channels 220 dispense a flow pattern 260 of the liquid 254, as shown in FIG. 10. FIG. 10 shows the dispensing of a high viscosity liquid 254 (such as a medicament in cream form, a cream for wound treatment) as an even and uniform controlled layer of liquid. The flow pattern 260 and the flow intensity can be advantageously controlled by adjusting the amount of squeeze force imparted upon the storage compartment 252 as previously discussed. In this way, the flexible pouch 202 surprisingly and advantageously provides a flexible pouch and dispensing system that can be operated entirely by hand—i.e., hand removal of long pocket 253, hand control (squeeze) of flow pattern 260, and hand treatment of wound 262.

Figure 11:
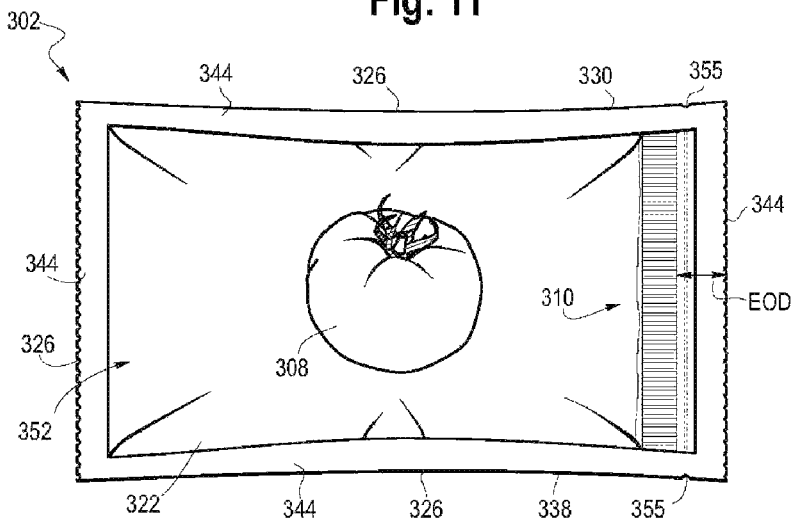
FIG. 11 is a top plan view of a flexible pouch with a microcapillary dispensing system in accordance with an embodiment of the present disclosure.
Figure 12:
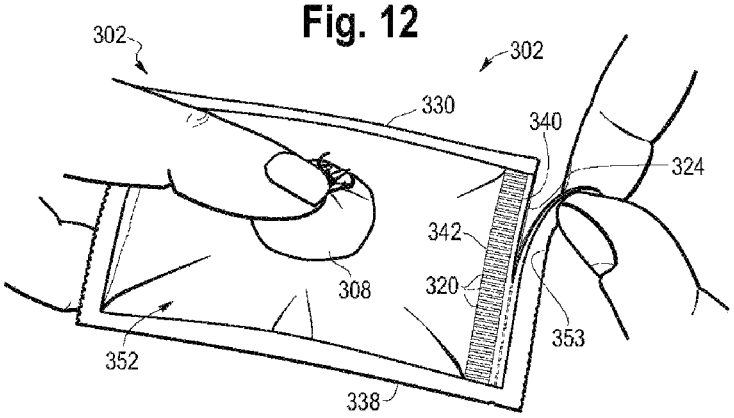
FIG. 12 is a perspective view of a pocket segment in accordance with an embodiment of the present disclosure.
Figure 13:
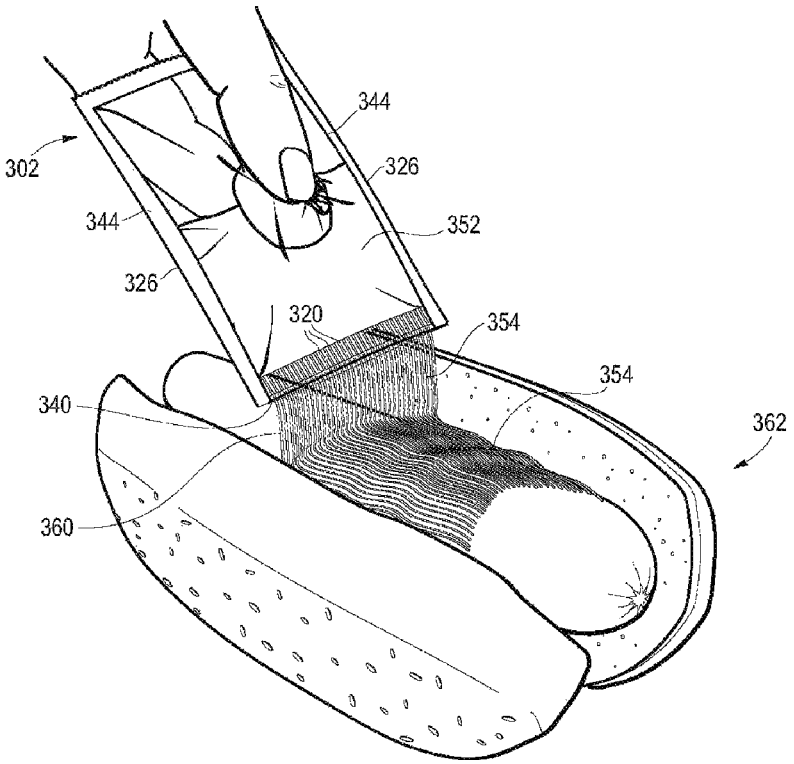
FIG. 13 is a perspective view of microcapillary dispensing from the flexible pouch in accordance with an embodiment of the present disclosure.

FIGS. 11-13 show another embodiment wherein flexible pouch 302 includes a long pocket 353. The edge offset distance, EOD, is the distance between the peripheral seal 344 and the outer edge 340 of the microcapillary strip 310, as shown in FIG. 11. The microcapillary strip 310 has an outer edge 340 and an inner edge 342.

Cut-outs (or notches) 355 in the peripheral seal 344 enable ready removal of the long pocket 353. The long pocket 353 and cut-outs 355 enable hand opening of the pouch 302 by way of hand tearing, or finger tearing, the long pocket 353 from the pouch 302.

An indicia 308 can be printed, or otherwise applied, on the outer surface of flexible film 322 and/or flexible film 324. The indicia 308 can be marketing or branding content, or can be information related to, or otherwise describing, the contents of the SUP 302 (such as ketchup, for example).

The flexible films 322, 324 define a common peripheral edge 326 as previously disclosed herein. The common peripheral edge 326 defines a 4-sided polygon (rectangle, square, diamond). In an embodiment, the first side 330 of the 4-sided polygon is parallel to, and does not intersect the second side 338 of the 4-sided polygon, as shown in FIG. 11.

In an embodiment, a squeezing force is imparted by hand upon the storage compartment 352. The squeezing force dispenses liquid 354 through the exposed channels 320 and out of the pouch 302. The exposed channels 320 dispense a flow pattern 360 of the liquid 354, as shown in FIG. 13. FIG. 13 shows the dispensing of a high viscosity liquid 354 (such as a comestible, such as a condiment) as an even and uniform controlled layer. The flow pattern 360 and the flow intensity can be advantageously controlled by adjusting the amount of squeeze force imparted upon the storage compartment 352 as previously discussed. In this way, the flexible pouch 302 surprisingly and advantageously provides a flexible pouch and food dispensing system that can be operated entirely by hand—i.e., hand removal of long pocket 353, hand control (squeeze) of flow pattern 360, and simplified and controlled dispensing of flowable comestible 354 (such as a condiment) a onto a food item 362, as shown in FIG. 13. Flexible pouch 302 advantageously provides controlled and measured dispensing of the comestible, reduces food spillage of the comestible, reduces or eliminates food mess from the comestible, and/or reduces or eliminates waste of comestible 354.

In an embodiment, any of the foregoing flexible pouches may include a closure. The closure covers the exposed channels after the release member is removed or the outer edge of the microcapillary strip is otherwise exposed to the external environment. Nonlimiting examples of suitable closures for the present flexible pouch include a Ziploc-type closure, hook and loop material (i.e., Velcro™), an adhesive strip (such as packaging tape, for example), and flexible material hingedly attached to the flexible pouch for placement over the exposed channels. The release member may also be configured to include a closure.

Any of the foregoing flexible pouches can have a storage compartment volume from 1.0 milliliter (ml), or 10 ml, or 100 ml, or 500 ml to 1 liter (L), or 10 L, or 100 L, or 1000 L.

Any of the foregoing flexible pouches may be produced as disclosed in applications, U.S. Ser. No. 62/186,103 filed on 29 Jun. 2015 and U.S. Ser. No. 62/185,939 filed on 29 Jun. 2015, the entire content of each application incorporated by reference herein.

By way of example, and not limitation, examples of the present disclosure are provided.

EXAMPLES

1. Multilayer Film

TABLE 1

Composition of the Flexible Multilayer Film (Film 1)
Laminated Multilayer Film

| Material | Description | Density (g/cm$^3$) ASTM D792 | Melt Index (g/10 min) ASTM D1238 (190° C./2.16 kg) | Melting Point (° C.) DSC | Thickness (micrometer) |
|---|---|---|---|---|---|
| LLDPE | Dowlex ™ 2049 | 0.926 | 1 | 121 | 20 |
| HDPE | Elite ™ 5960G | 0.962 | 0.85 | 134 | 20 |
| LLDPE | Elite ™ 5400G | 0.916 | 1 | 123 | 19 |
| Adhesive Layer | Polyurethane solvent less adhesive (ex. Morfree 970/CR137) | | | | 2 |
| HDPE | Elite ™ 5960G | 0.962 | 0.85 | 134 | 19 |
| HDPE | Elite ™ 5960G | 0.962 | 0.85 | 134 | 20 |
| Seal Layer | Affinity ™ 1146 | 0.899 | 1 | 95 | 20 |
| | | Total | | | 120 |

2. Flexible Stand-Up Pouch with Microcapillary Strip Made In Situ (Example 1)

A. Microcapillary 1

The channels (capillaries) are produced by using a parallel array of hardened stainless steel wires disposed between two monolayer sheets of INFUSE™ 9500 previously prepared by compression molding.

INFUSE™ 9500 strip dimensions: approximately 1 cm by 5 cm

Thickness (T): 0.22 mm

Stainless steel wire diameter (D): 0.22 mm

Wire spacing (S): 0.44 mm

Number of pins: 17

B. Microcapillary 2

The channels (capillaries) are produced by using a capillary precursor element (CPE) with an array of non-parallel (divergent) nickel titanium alloy wires disposed between two monolayer sheets of INFUSE™ 9107 (INFUSE™ strips) previously prepared by compression molding as disclosed in copending case U.S. Ser. No. 62/185,939 filed 29 Jun. 2015.

INFUSE™ 9107 strip dimensions: approximately 1 cm by 5 cm

Thickness (T): 300 micrometers

Stainless steel wire diameter (D): 400 micrometers

Wire spacing (S): 800 micrometers at the base

Number of pins: 13

C. Process

1. The capillary precursor element includes an array with stainless steel wires that is placed between the two INFUSE™ strips. The wires can be parallel to each other. Alternatively, the wires are divergent, or non-parallel, with respect to each other. The INFUSE™ strips cover the total width of the wire array and have an excess of approximately 10 mm on each side. The INFUSE™ strips do not cover the length of the wires leaving approximately 5 mm of uncovered wires on each side. The capillary precursor element is then placed between two opposing pieces of Film 1. The seal layers face each other and the two Film 1 films are arranged to form a common peripheral edge. The capillary precursor element is placed in the Brugger HSG-C heat sealer equipped with a Teflon coated heat seal bar measuring 6 mm by 150 mm and first heat sealed for 1 second at 120° C. with 900 Newton (N) force corresponding to a pressure of 100 $N/cm^2$. The first sealing process results in the complete fusion of the two INFUSE™ strips around the steel wires completely encapsulating them and forming a polymeric matrix. The first sealing simultaneously seals the matrix to the back film and the front film of the pouch.

2. The steel wire array is subsequently extracted from the pouch by pulling away by hand, revealing an array of round channels connecting the inside of the package. The wire array is easily removed by hand without any damage to the pouch or the formed channels.

3. The pouch is filled with tap water through the opposite corner which was also left opened to 75% of the maximum pouch volume.

4. The water-filled pouch is closed by second heat sealing the edges in the same Brugger HSG-C heat sealer equipped with a Teflon coated heat seal bar measuring 6 mm by 150 mm at 130° C. and 900 N of seal force corresponding to a pressure of 100 $N/cm^2$. The second seal force is high enough to collapse the channels at the peripheral edge and completely seal the pouch. The filled and sealed flexible pouch with finished corner with example Microcapillary 1 showing the microcapillary strip with parallel channels installed is shown in FIG. 5.

The corner of example Microcapillary 2 showing in situ microcapillary strip with non-parallel channels is shown in FIG. 8A.

5. Excess material left over from the strips during the sealing process is trimmed to finish the packaging.

D. Functionality Demonstration

The corner of the pouch is cut off using a regular scissors to remove sealed microcapillary segment, thereby exposing the edges of the channels. The pouch is gently squeezed by hand and a fine spray of an aqueous solution is discharged from the pouch as depicted in FIG. 5 (parallel channels) and FIG. 8A (non-parallel channels). It is specifically intended that the present disclosure not be limited to the embodiments and illustrations contained herein, but include modified forms of those embodiments including portions of the embodiments and combinations of elements of different embodiments as come within the scope of the following claims.

We claim:

1. A flexible pouch comprising:

opposing flexible films, the flexible films defining a common peripheral edge;

a microcapillary strip sealed between the opposing flexible films, the microcapillary strip composed of a matrix of a polymeric material, and a plurality of channels wholly disposed in the matrix polymeric material;

a first side of the microcapillary strip located at a first side of the common peripheral edge and a second side of the microcapillary strip located at a second side of the common peripheral edge;

a peripheral seal along at least a portion of the common peripheral edge, the peripheral seal comprising a sealed microcapillary segment.

2. The flexible pouch of claim 1 wherein the peripheral seal forms a closed flexible pouch having a storage compartment.

3. The flexible pouch of claim 2 comprising a liquid in the storage compartment.

4. The flexible pouch of claim 1 comprising a fill inlet.

5. The flexible pouch of claim 1, wherein the common peripheral edge defines a 4-sided polygon, the first side of the microcapillary strip is located at a first side of the 4-sided polygon; and the second side of the microcapillary strip is located at an intersecting side of the 4-sided polygon.

6. The flexible pouch of claim 1, wherein the common peripheral edge defines a 4-sided polygon, the first side of the microcapillary strip is located at a first side of the 4-sided polygon; and the second side of the microcapillary strip is located at a parallel side of the 4-sided polygon.

7. The flexible pouch of claim 1 comprising a release member, the release member comprising a portion of the sealed microcapillary segment, the release member exposing channels of the microcapillary strip when the release member is removed from the flexible pouch.

8. The flexible pouch of claim 7 comprising:

a squeezing force imparted upon the storage compartment; and a flow of the liquid through the exposed channels of the microcapillary strip.

9. The flexible pouch of claim 1 comprising a closure for the exposed channels.

10. A flexible pouch comprising:

opposing flexible films, the flexible films defining a common peripheral edge;

a microcapillary strip located at an edge offset distance between the opposing flexible films, the microcapillary strip sealed between the opposing flexible films, the microcapillary strip composed of a matrix of a polymeric material, and a plurality of channels wholly disposed in the matrix polymeric material;

a first side of the microcapillary strip located at a first side of the common peripheral edge and a second side of the microcapillary strip located at a second side of the common peripheral edge; and a peripheral seal along at least a portion of the common peripheral edge.

11. The flexible pouch of claim 10 wherein the common peripheral edge comprises a sealed microcapillary segment.

12. The flexible pouch of claim 10 wherein the peripheral seal forms a closed flexible pouch having a storage compartment and a pocket.

13. The flexible pouch of claim 10 comprising a liquid in the storage compartment.

14. The flexible pouch of claim 10 comprising a fill inlet.

15. The flexible pouch of claim 10, wherein the common peripheral edge defines a 4-sided polygon, the first side of the microcapillary strip is located a first side of the 4-sided polygon; and the second side of the microcapillary strip is located at an intersecting side of the 4-sided polygon.

16. The flexible pouch of claim 10, wherein the common peripheral edge defines a 4-sided polygon, the first side of the microcapillary strip is located at a first side of the 4-sided polygon; and the second side of the microcapillary strip is located at a parallel side of the 4-sided polygon.

17. The flexible pouch of claim 12 wherein channels of the microcapillary strip are exposed when the pocket is removed from the flexible pouch.

18. The flexible pouch of claim 17 comprising:

a squeezing force imparted upon the storage compartment; and a flow of the liquid through the channels of the microcapillary strip.

19. The flexible pouch of claim 10 comprising a closure for covering the exposed channels.

20. The flexible pouch of claim 1 wherein the flexible pouch is a stand-up pouch.

* * * * *